United States Patent [19]

Winch et al.

[11] 4,300,267

[45] Nov. 17, 1981

[54] TOTAL FIBER RECOVERY METHOD AND APPARATUS

[75] Inventors: Allen R. Winch, Westfield, N.J.; Joseph K. Jones, Raleigh, N.C.

[73] Assignee: Cotton, Incorporated, New York, N.Y.

[21] Appl. No.: 118,976

[22] Filed: Feb. 6, 1980

[51] Int. Cl.[3] ..... D01G 9/00

[52] U.S. Cl. ..... 19/200; 19/80 R; 19/85; 19/99; 19/107; 209/22

[58] Field of Search ..... 19/40, 41, 80 R, 85, 19/87, 93, 98, 99, 107, 39, 65 R, 90, 144, 200, 96; 209/22

[56] References Cited

U.S. PATENT DOCUMENTS

| | | | |
|---|---|---|---|
| 631,800 | 8/1899 | Lemoine | 19/85 |
| 661,166 | 11/1900 | Boyd | 19/65 R |
| T971,001 | 6/1978 | Mangialardi | 19/39 |
| 1,037,340 | 9/1912 | Shaughnessy | 19/96 |
| 1,259,243 | 3/1918 | Keough | 19/87 |
| 1,449,392 | 3/1923 | Freeman | 19/80 R |
| 1,479,537 | 1/1924 | Garner | 19/87 |
| 1,667,505 | 4/1928 | Assiter | 19/85 |
| 1,669,771 | 5/1928 | Mitchell et al. | 19/40 |
| 1,690,375 | 11/1928 | Mitchell et al. | 19/41 |
| 1,714,953 | 5/1929 | Hancock | 19/93 |
| 2,219,285 | 10/1940 | Allen et al. | 19/144 X |
| 2,632,924 | 3/1953 | Bertram et al. | 19/90 |
| 3,486,309 | 12/1969 | Wild | 19/107 X |
| 3,559,804 | 2/1971 | Lytton | 19/93 |
| 3,858,276 | 1/1975 | Hollingsworth | 19/98 |
| 3,897,018 | 7/1975 | Wilkes | 19/80 R |
| 3,984,896 | 10/1976 | Hicks | 19/200 X |
| 3,987,615 | 10/1976 | Hill | 19/65 R |
| 4,040,948 | 8/1977 | Wirth | 209/22 |
| 4,126,914 | 11/1978 | Winch et al. | 19/99 |
| 4,219,908 | 9/1980 | Winch et al. | 19/99 |
| 4,229,286 | 10/1980 | Bridges | 209/22 |
| 4,258,455 | 3/1981 | Werner | 19/200 X |

FOREIGN PATENT DOCUMENTS

| | | | |
|---|---|---|---|
| 821422 | 10/1959 | United Kingdom | 19/107 |
| 2010936 | 7/1979 | United Kingdom | 19/107 |

*Primary Examiner*—Louis Rimrodt

*Attorney, Agent, or Firm*—Burns, Doane, Swecker & Mathis

[57] ABSTRACT

A total fiber recovery method and apparatus are disclosed which will recover substantially all of the usable fiber contained in discarded waste material comprising a mixture of fibers, motes and trash. The method consists of conveying the input material into a cleaner and opener which rejects a large portion of the heavy trash and motes. The remaining fiber is transported into a lint cleaner which drops out more motes and smaller trash. From there the partially cleaned fiber is transported to a first cleaner and carder which will clean and orient the fiber. The trash and motes rejected by the cleaner and opener, the lint cleaner, and the first cleaner and carder are collected and cleaned in a drum screen cleaner to remove the heavy trash. The partially cleaned fiber is then transported into a carder and opener where the fibers, including the motes, are fully opened. The opened fiber is then transported to a second cleaner and carder for cleaning and orienting. The outputs of the first and the second cleaner and carder are baled separately to obtain a long fiber fraction and a short fiber fraction respectively.

26 Claims, 7 Drawing Figures

21
23
25
27
29
31
32
33
34
35
36
37
39
41
43
45
46
47
48
49
51
53
55
57
59
61
63
65
67
69
71
72
73
75
77
79
81
82
83
85
87
88
89
90
91
93
95
97
98
99
101
103
105
107
109
111
113
115
120
121
122
123
125
126
401
402
405
406
407
410

TOTAL FIBER RECOVERY METHOD AND APPARATUS

BACKGROUND AND SUMMARY OF THE PRESENT INVENTION

The present invention relates to a total fiber recovery method and apparatus for cotton. More particularly, the present invention relates to a method and apparatus for recovering substantially all of the usable fiber which is separated with the waste in conventional ginning and textile mill cleaning processes.

During conventional cleaning of cotton fiber at the gin and during the first part of textile processing, some fiber is lost with the trash which is removed. The fiber that is removed, particularly at the gin, is very valuable if the fiber can be separated from the trash without reducing the fiber properties of the good fiber.

Several attempts have been made to recover substantially all of the usable fiber which is discarded with the trash from a cotton gin. However, these attempts have not met with great success. Often, any fiber which was recovered by the prior systems was not clean enough to be used for spinning or weaving. Other systems still threw away a substantial quantity of good fiber in the recovery system and therefore proved uneconomical because of a low yield.

One prior system is disclosed in the defensive publication T971,001 of Mangialardi Jr. The Mangialardi Jr. defensive publication discloses an apparatus for reclaiming lint cotton and returning it to the ginning process. The apparatus includes a drying and cleaning device which removes moisture and large particles of trash. The partially cleaned fibers are then moved into a second cleaning stage comprising an extractor feeder and gin stands. Trash from these two stages are sent to a central waste collection bin. The clean fiber is then moved into a series of saw-type lint cleaners in which further waste material is removed. The waste material from these lint cleaning stages is then brought into a reclaiming apparatus which comprises a further lint condenser and lint cleaner. The reclaimed lint from this stage is then returned to the first saw-type lint cleaner to be recycled through the system.

U.S. Pat. No. 3,987,615 issued to Hill, Jr. discloses a process for reclaiming cotton fibers from gin motes. The process includes initially cleaning the gin motes to remove large trash and then carding and drafting the cleaned motes to obtain a cleaner fiber.

Another process is disclosed in U.S. Pat. No. 1,669,771 issued to Mitchell et al. The Mitchell et al patent discloses a method of reclaiming seed cotton discharged with the hulls from a cotton cleaning process. The Mitchell et al patent discloses subjecting the waste products to the action of fan blades to loosen up cotton locks so that the cotton contained therein can be more readily engaged by the teeth of the saw cylinders employed for reclaiming the cotton.

Other waste cleaning systems are disclosed in U.S. Pat. Nos. 2,632,924; 2,219,285; 1,690,375; 1,037,340 and 661,166.

There is no assurance in these prior art systems of recovering substantially all of the usuable fibers from the waste. In particular, the motes are not adequately opened by the conventional methods employed by the prior art. The motes comprise cotton fiber aggregates which are sufficiently dense to be discarded with the trash in conventional cleaning processes. The motes include "pills" which are tightly packed balls of cotton. The majority of prior fiber recovery methods merely recycle the material rejected through the same processing steps in an attempt to reclaim at least some of the usable fiber. Without providing additional processing steps, it is apparent that these prior art methods will still reject a substantial quantity of good fiber, particularly the fibers contained in the motes.

It is an object of the present invention to provide a method for reclaiming substantially all of the good cotton fiber from the material which is removed in a conventional ginning process or during the first part of cotton textile processing.

It is a further object of the present invention to provide a method of removing fiber from former waste materials which separates the fibers into two distinct fiber groups, the first group consisting of a long fiber fraction and the second group consisting of a short fiber fraction. A long fiber fraction is a quantity of fiber containing a higher concentration of long fibers while a short fiber fraction contains a higher concentration of short fibers.

Still a further object of the present invention is to provide a method for cleaning the waste from a cotton gin which method produces a fiber with a low non-lint content and also minimizes further losses of good fiber during the fiber reclaiming process.

A still further object of the present invention is to provide a method of cleaning waste material from a gin which opens cotton motes and produces useful fibers from these motes.

These and other objects of the present invention are achieved by providing a method which consists of opening bales of waste provided from ginning processes and subjecting this waste to a first cleaning and opening step where a quantity of trash and motes are discarded. The partially cleaned material is then conveyed into a lint cleaning stage from which more trash and motes are rejected. From there, the partially cleaned fiber is transported to a reserve hopper-feeder which feeds into a first cleaner and carder. This first cleaner and carder will also dump out more trash along with cotton motes.

The present invention also provides for collecting the trash from the initial cleaning stage, the lint cleaner, and the first cleaner and carder. The collected trash and lint is then fed into a cyclone to remove the air from the trash and fibers contained therein. This formerly wasted material is then transported into a drum screen cleaner which drops out essentially only the non-lint solid waste fraction while retaining the lint and fiber motes. The lint and fiber motes from the drum screen cleaner are then conveyed into a carder and opener. In the carder and opener, the motes remaining including the "pills" are all opened.

According to a preferred embodiment of the present invention, the fiber from the carder and opener is then conveyed into a second cleaner and carder to further clean and orient the retained fibrous material. According to this embodiment of the present invention, the fiber product outputs of the first cleaner and carder, and the second cleaner and carder will be separate. The output of the first cleaner and carder will consist of a long fiber fraction whereas the output of the second cleaner and carder will consist of a short fiber fraction.

According to another embodiment of the present invention the opened fibers from the carder and opener are conveyed back to the first cleaner and carder and mixed with the fibers obtained from the initial cleaning stage to produce a single output of mixed fiber lengths.

According to a further embodiment of the present inventon, the varying lengths of fiber are maintained separate by employing a holding bin for the cleaned material from the drum screen cleaner. In this way, the lint containing the long fiber fraction is processed first through a single cleaner and carder. Subsequently the material reserved from the drum screen cleaner is conveyed into the carder and opener and then conveyed into the single cleaner and carder opener to be further cleaned and oriented separately to obtain a short fiber fraction.

BRIEF DESCRIPTION OF THE DRAWINGS

These and other objects will become apparent to those skilled in the art with reference to the accompanying drawings illustrating the preferred embodiments of the present invention wherein like members bear like reference numerals and wherein.

DETAILED DESCRIPTION OF THE PREFERRED EMBODIMENTS

Figure 1:
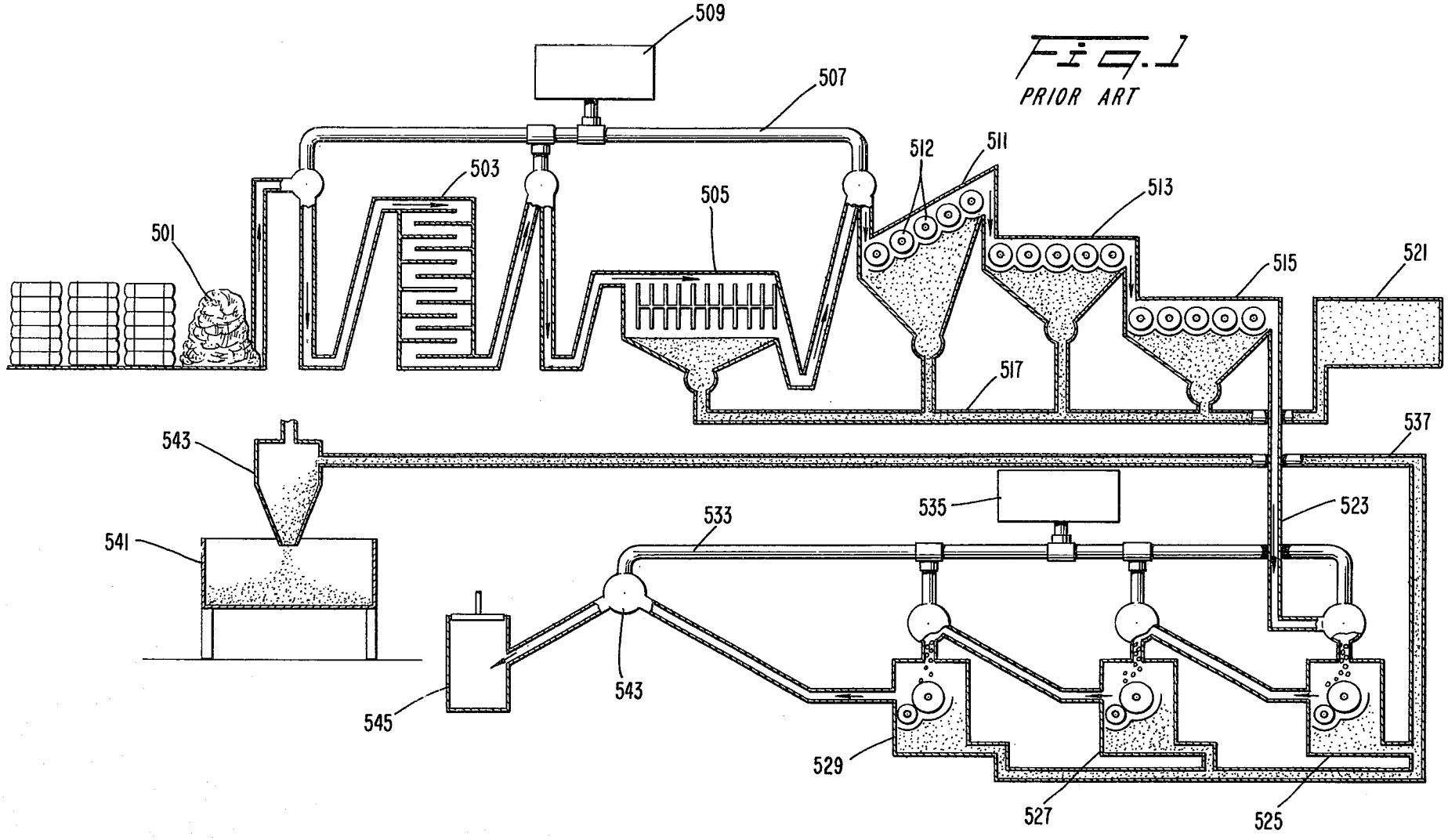
FIG. 1 PRIOR ART
FIG. 1 is a schematic view of a conventional fiber recovery system.

With reference to FIG. 1, a conventional fiber recovery system opens waste material received from the gins at a first station 501 by any suitable opening device. The opened material, consisting of trash and cotton, is then usually conveyed into at least one drier 503 to remove moisture from the material. Some systems employ a second drier 505 depending upon the moisture content of the input material. Dust and lint fly generated during the opening and drying stages are removed by a line 507 and delivered to a dust house 509 to be disposed of in the usual manner.

After leaving the drier 505, the material is conveyed to a series of standard cleaners. With reference to FIG. 1, an incline cleaner 511 and two horizontal cleaners 513, 515 can be utilized. The number of such cleaners varies depending upon the quality of the input feed and the quality of the output product desired. The general method of operation of the incline or horizontal cleaner is to kick and fluff the cotton with beater cylinders 512. This fluffing action allows larger, heavier trash particles to drop out by gravity. However, these cleaners tend to rope or twist longer fibers thereby reducing the quality of the lint reclaimed. The trash rejected by the cleaners is collected in a line 517 and delivered to a trash bin 521 to be carried to a trash dump.

The material remaining after processing in the cleaners 511, 513, and 515 is conveyed through a line 523 by air to one or more lint cleaners 525, 527, 529. The number of lint cleaners employed varies, as does the exact design of the lint cleaners. Essentially, the lint cleaners are used primarily for cleaning only and not for further opening of the material introduced. The majority of plants use only two lint cleaners in series.

Dust from the lint cleaners 525, 527, 529 is collected in a line 533 and delivered to a dust house 535. Trash and motes including pills (small, tightly packed tufts of cotton) which are removed by the lint cleaners 525, 527, 529 are collected in a line 537 and delivered to a cyclone separator 543 which discharges waste material to a holding bin 541.

The reclaimed lint from the last lint cleaner 529 is conveyed to a conventional condenser 543 to separate the air from the lint. The lint is then fed to a bale press 545 to be bundled and sold.

The trash and motes collected in the bin 541 are run through a condenser and then packed in a bale press (not shown). In some systems the motes and trash are returned to the incline and horizontal cleaners 511, 513 and 515 to remove any residual trash which is contained with the motes. These motes, whether re-cleaned or not, are typically sold separately from the reclaimed lint and are used for different purposes.

Figure 2:
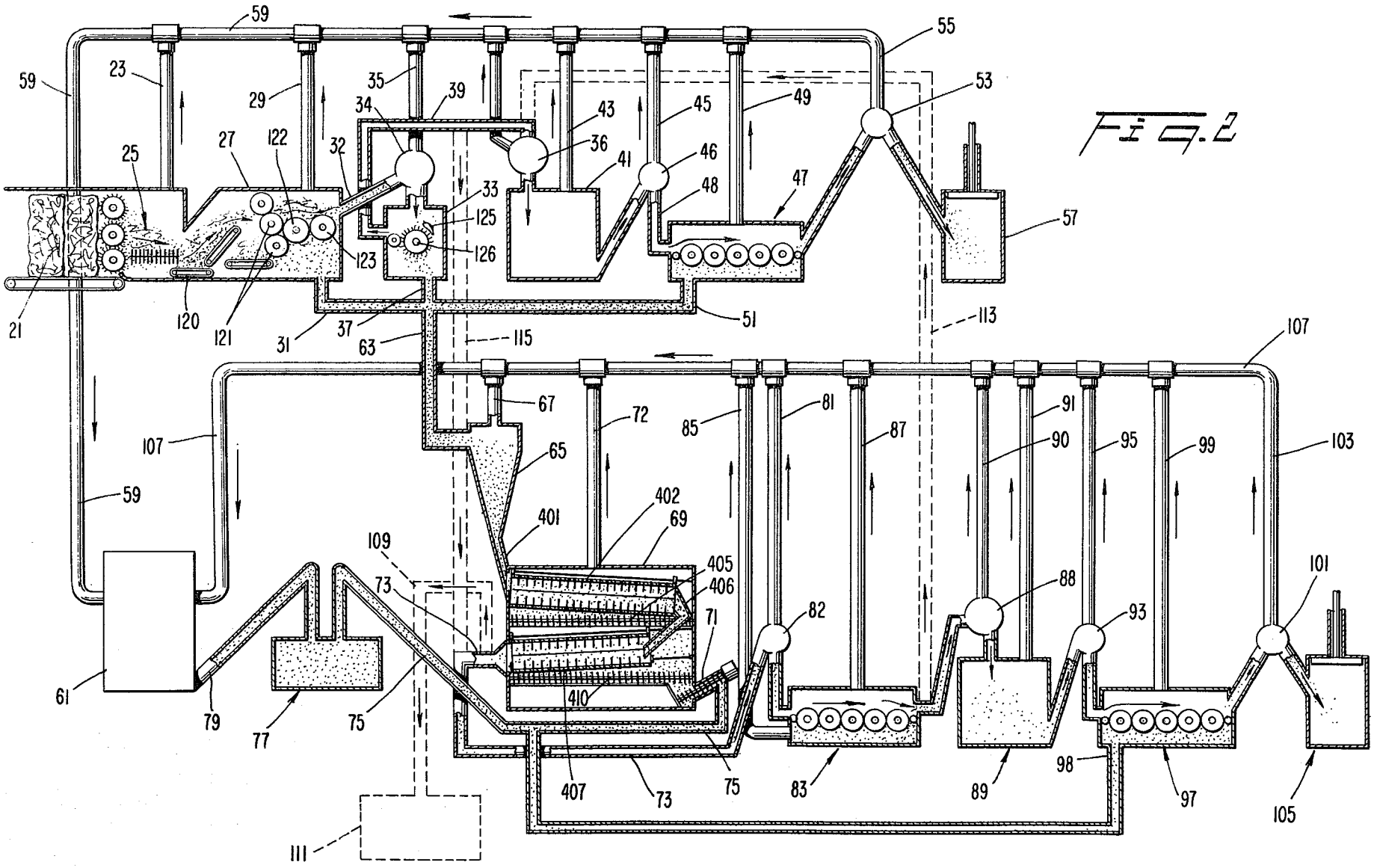
FIG. 2 is a schematic view of a fiber recovery system according to the present invention.

With reference to FIG. 2, the process of the present invention begins by opening the bales of waste received from the cotton gins or textile plants with a bale opener 21. The bale opener can be of several designs and is preferably designed to handle bales of different sizes. The bale opener 21 could, for example, embody the principles of the module gin feeders described in U.S. Pat. Nos. 3,897,018 and 4,006,814 which are hereby incorporated by reference. The width of the bale opener 21 is preferably about 10 feet wide to handle five normal size bales which can be blended together to give a high degree of control over the uniformity of the end product. Furthermore, the bale opener could feed two separate processing lines for increased capacity. Any dust or lint fly generated in the bale opener is preferably removed by air suction through a line 23.

The material from the bale opener 21 is conveyed to the next stage by any suitable apparatus (for example, a moving belt). After opening, the material is deposited into a drier 25 which is used to a greater or lesser extent depending on the moisture content of the material received. The drier can be of any conventional design. However, in a preferred embodiment a modified trough drier with a screened bottom has been found to be suitable.

The material from the drier 25 is then conveyed into a first opening and cleaning station 27. This opening and cleaning station could, for example, be the cleaner made by the RANDO TM Machine Corporation. The cleaner 27, shown schematically in FIG. 2, consists of a pair of lickerin processing cylinders 121 having a plurality of positive rake teeth along their peripheries which pick up material deposited on a conveyor 120. The cylinder 122, which has teeth on its periphery with a negative rake, removes the loosely held cotton from the lickerin cylinders 121. A cleaning grid section (not shown) disposed adjacent to the lower portion of cylinder 122 further opens the cotton containing material and removes motes and particles of trash. The material remaining on the cylinder 122 is removed by an air brush cylinder 123 and the material is then conveyed by air through the discharge line 32.

The opening and cleaning station 27 removes approximately 30 to 60 percent of the material received including large particles of trash, leaf particles, burrs, stems, and motes (denser aggregates of fiber) and some stray fibers. All of this discarded material is collected in a line 31 at the lower end of the cleaning station 27. Dust and lint fly produced during this opening and cleaning step are removed by air suction through a line 29. The material retained by the cleaner is picked up by air and conveyed through the line 32 discharging through a condenser 34 to a gin-type lint cleaner 33.

The lint cleaner is of a conventional design and could, for example, be one of the saw lint cleaners described in *Cotton Ginners Handbook* published by the U.S. Department of Agriculture July 1977, p. 35–41. In a preferred embodiment the lint cleaner is adjusted to a close tolerance between the feed plate 125 and the cleaning saw cylinder 126. With this adjustment, the lint cleaner effectively opens the fiber in addition to cleaning the fiber. The lint cleaner should remove another 5 to 10 percent of the remaining trash along with more fiber motes which are collected in an outlet line 37. The dust and lint fly produced in the lint cleaner is removed by air suction through a line 35.

The material retained by the lint cleaner 33 is transported by air through a line 39 to a condenser 36 which discharges material into a reserve hopper-feeder 41. The reserve hopper-feeder 41 also has a dust and lint fly removal line 43. From the reserve hopper-feeder 41, the cotton moves by air to a condenser 46 (from which dust is removed via a line 45) and into a uniform chute feed 48 which feeds a first cleaner and carder 47. The cleaner and carder is preferably of the type described in greater detail with reference to FIG. 3 and also disclosed in U.S. Pat. No. 4,126,914 which is incorporated herein by reference. Dust and lint fly from the cleaner and carder are removed through a suction line 49. The cleaner and carder retains about 50 percent of the material introduced and rejects trash and motes through the bottom. The discarded material is collected in a line 51.

From the cleaner and carder, the cleaned and oriented fiber is then moved through a standard condenser 53, from which further dust is removed through a line 55. The clean, long fiber fraction is then conveyed into a first bale press 57 to be baled and sold. The dust removed from each of the proceeding steps through the lines 23, 29, 35, 43, 45, 49, and 55 are all collected in a line 59 which conveys the dust and lint fly to a dust house 61.

The materials rejected in the first cleaning station 27, the lint cleaner 33, and the first cleaner and carder 47 (which were collected in lines 31, 37, and 51, respectively) are collected in a single line 63 which leads to a long body cyclone 65 of conventional design. The cyclone 65 separates the air from the trash and the motes. Any dust or lint fly produced in the cyclone is removed through a line 67. Due to the centrifugal action in the cyclone 65, the solid material tends to collect into irregular shaped balls.

Figure 5:
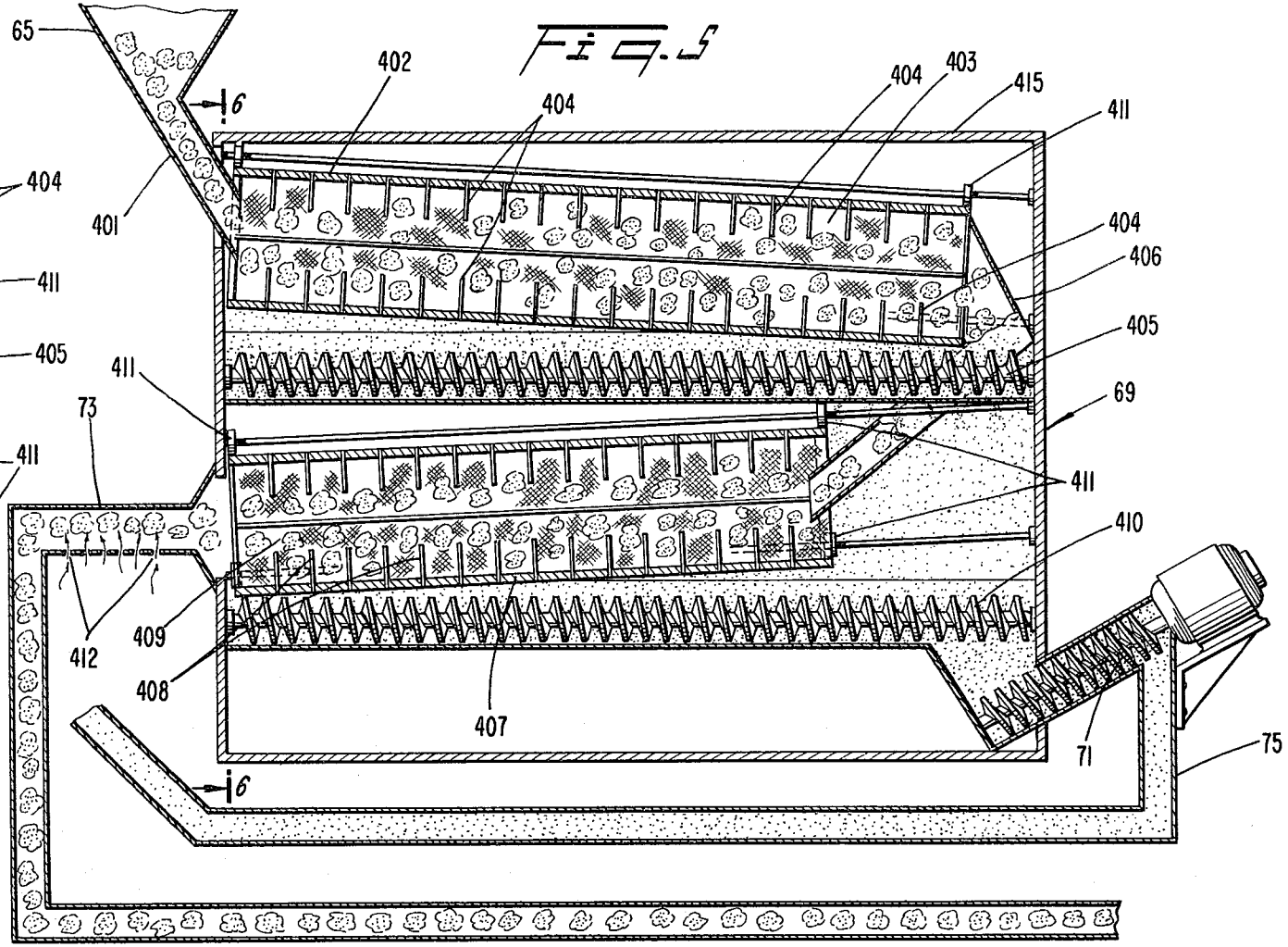
FIG. 5 is a simplified cross-sectional view of a drum screen cleaner according to the present invention.
Figure 6:
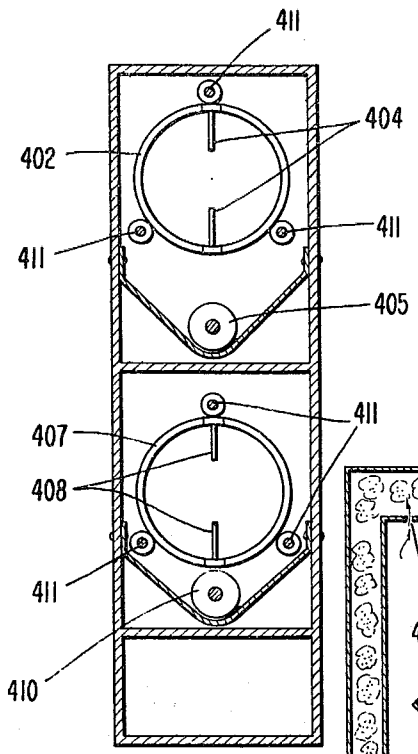
FIG. 6 is a view taken substantially along the line 6—6 in FIG. 5.

By gravity, the material drops out of the cyclone 65 and is fed into the top of a drum screen cleaner 69 through a line 401 (FIGS. 5 & 6). The drum screen cleaner is described in more detail in commonly assigned copending U.S. application Ser. No. 118,977 filed Feb. 6, 1980 by Joseph K. Jones which application is hereby incorporated by reference. The material enters a first rotary drum 402 of the cleaner, having a screen 403 around the periphery thereof. Under slight negative pressure, the material is tumbled to shake out the heavier trash particles as explained below. The negative pressure is obtained by withdrawing air through a vent (not shown) in the cleaner housing 415. On the inner circumference of the first drum 402, finger-shaped baffles 404 are arranged in two rows disposed 180° apart. In a preferred embodiment, each of the baffles is made from $\frac{1}{4}''$ round stock which is cut to a length of 6 inches. The baffles are preferably spaced 6 inches apart along the horizontal length of the drums.

The baffles 404 lift the fiber material during rotation of the drum 402 about its axis and drop or tumble the fiber onto the screen 403, similar to a vibration action. These finger-shaped baffles 404 are spaced sufficiently far apart to allow the clusters of material to pass therebetween and to continue pulling the fiber masses apart for greater opening and better heavy trash removal. The amount of lift imparted to the fiber by the baffles 404 depends on the size and shape of the incoming material and also upon how well the material is picked up or balanced on the individual baffles. The pulling action caused by the baffles 404 breaks up the material and frees a large percentage of the heavier trash. The continuous action of the baffles 404, as the material moves by gravity down through the first drum 402, breaks up any remaining clusters of material to expose more trash and allow the trash to drop out through the screen 403.

The trash which drops out of the first drum 402 is collected by a first screw conveyor 405 disposed underneath the first drum 402. The trash collected on the first conveyor 405 moves from left to right as seen in FIG. 5 and is discharged downwardly by gravity and eventually picked up by conveyor 71 and transported via line 75 to the solid waste disposal system 77 (FIG. 2).

The material remaining in the first drum 402 moves through a line 406 to a second drum 407 containing baffles 408 similar to the baffles 404 in the first drum 402. A lifting and dropping action again occurs in the second drum 407 to separate more heavy trash from the material. The trash which drops through a screen 409 encircling the second drum 407 is collected on a second screw conveyor 410. The trash is transported by the screw conveyor 410 to the conveyor 71 and removed to the solid waste disposal system 77 (FIG. 2).

Each of the first and the second drums 402, and 407 are friction-driven by a plurality of rollers 411 (FIG. 6). At least one of the rollers on each drum is mounted on a cam arm which is spring loaded (not shown) to maintain the drums in proper alignment and in driving contact with the rollers 411. The rollers are preferably composed of a suitable rubber-like material to provide greater friction and to reduce noise.

In a preferred embodiment, the screens 403, 409 surrounding the drums 402, 407 having openings of approximately $\frac{1}{4}$ of an inch in diameter. The screen opening size of approximately $\frac{1}{4}''$ in diameter (either square or circular) allows the trash to drop through and be removed by the screw conveyors 405, 410. However, the fiber motes will not fall through. The motes are the dense fiber aggregates which, until the present invention, have been rejected in fiber recovery systems since these motes could not be opened by conventional processing methods. If the screen opening size were increased substantially the motes could also drop through. If the screen opening size were decreased, the heavy trash would not drop through as is desirable.

The chances of entanglement of fibers in the drum screen cleaner are reduced by the location of the drum screen cleaner 69 in the fiber recovery system. Since the long fiber fraction has been retained by the first opening and cleaning stage 27, the lint cleaner 33, and the first cleaner and carder 47, the long fiber fraction is not fed into the drum screen cleaner 69. In this way, the drum screen cleaner can be more effectively used to separate the trash from the motes. Since only the motes are conducted into the drum screen cleaner, there is less likelihood that fibers will become entangled on the screens or the baffles as the motes and trash are tumbled. Dust is removed from the drum screen cleaner 69 through a line 72.

A mechanism of any suitable design (not shown) can be provided for adjusting the angle of tilt on each of the drums 402, 407. In a preferred embodiment, each of the drums can be adjusted from a horizontal position to a drop of 6 inches from the inlet to the outlet of each drum. Also, in the illustrated embodiment, the first drum 402 is 10 feet long and 2 feet in diameter, while the second drum 407 is 8 feet long and 2 feet in diameter. For these drum sizes, 6-inch diameter screw conveyors have been found to be appropriate. In the preferred embodiment, the two drums are rotated at a speed between 24–30 RPM.

It may be preferable to arrange the shorter drum above the longer drum. Among other advantages, this arrangement would permit the line 406 to be arranged substantially centrally from the outlet of the first drum to the inlet of the second drum instead of towards the right or the left of the first screw conveyor 405 as in the illustrated embodiment. The relative length of the drums is not critical to the operation at the drum screen cleaner and the drums could be constructed to be substantially the same length if desired.

The material retained by the drum screen cleaner 69, i.e., motes and lighter trash, are conveyed by air received through openings 412 in the line 73 to a condenser 82 (from which dust is removed via a line 81) and fed into a carder and opener 83. The carder and opener 83 has a solid plate covering the opening under the feed plate as described in more detail with reference to FIG. 4 and also in commonly assigned copending Application Ser. No. 905,964, now U.S. Pat. No. 4,219,908, granted Sept. 2, 1980, of Allen R. Winch and Charles H. Chewning which is incorporated herein by reference. By closing the opening under the feed plate, fibrous material, particularly the motes, and trash are not allowed to drop out as in the cleaner and carder 47. The only waste removal in the carder and opener 83 is through lines 85 and 87 which remove fine dust and lint fly. The arrangement of the carder and opener opens all of the fibrous material including the motes and orients these opened fibers to produce a short fiber fraction.

In a preferred embodiment, the short fiber fraction and light trash leaving the carder and opener 83 are fed via a condenser 88 (from which dust is removed through a line 90) to a second reserve hopper-feeder 89 from which dust is removed through a line 91. The second reserve hopper-feeder 89 feeds a standard condenser 93 which leads to a second cleaner and carder 97 substantially the same as the cleaner and carder 47. Dust from the condenser 93 and the second cleaner and carder 47 are removed via lines 95 and 99, respectively. The light trash remaining with the short fiber fraction is removed through the opening under the feed plate and delivered through a line 98 to the line 75 and thereafter to the solid waste disposal system 77. The fully cleaned and oriented material from the second cleaner and carder 97 is fed to a final condenser 101 which feeds a second standard bale press 105. Dust and lint fly from the condenser 101 are removed via a line 103 and are collected, along with all the dust and lint fly removed from the various preceeding stages through lines 67, 72, 81, 85, 87, 91, 95 and 99, in a line 107 and delivered to the dust house 61.

Figure 7:
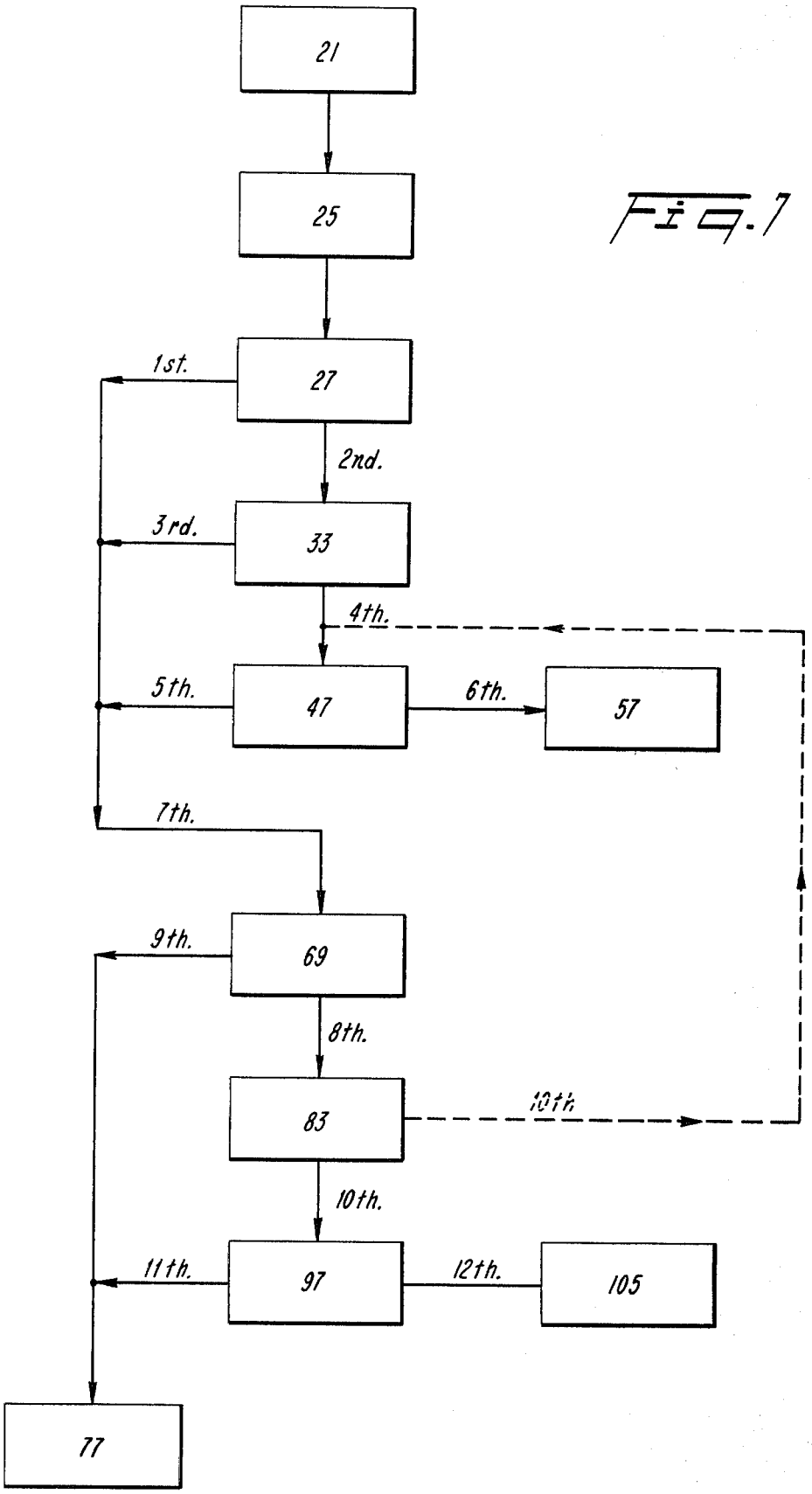
FIG. 7 is a simplified block diagram similar to FIG. 2, illustrating the flow of material through the fiber recovery system of the present invention.

In operation, and referring to FIGS. 2 and 7, bales comprising the waste from a cotton ginning process or early textile mill fiber process is opened by the bale opener 21 to form an input feed of a mass of randomly oriented mixed fibers, motes and trash. This input feed is conveyed to the drier 25 to remove any moisture contained therein.

The input feed is opened at the first opening and cleaning station 27. The opening process separates the input feed into a first portion of the input feed primarily comprising trash and motes which are collected in the line 31 at the base of the opening and cleaning station 27. A second portion of the input feed comprising fibers and relatively smaller trash is retained by the opening and cleaning station 27 and conveyed through the line 32 to the lint cleaner 33.

The second portion of the input feed is cleaned and opened in the lint cleaner 33 to remove a third portion of the input feed comprising motes and relatively smaller trash and to retain a fourth portion of the input comprising a long fiber fraction with lesser quantities of motes and trash. The third portion of the input feed is collected in the line 37. The fourth portion is conveyed through the line 39, the reserve hopper feeder 41, and condenser 46 to the first cleaner and carder 47.

The fourth portion of the input is cleaned and carded in the first cleaner and carder 47 to obtain a sixth portion of the input comprising a long fiber fraction. The cleaning and carding is accomplished by subjecting the fourth portion to a plurality of abrupt deflections and acceleration in a circular travel direction to assist in cleaning and orienting the fibers of the fourth portion. The abrupt deflections and accelerations also cause a fifth portion of the input comprising small trash and motes to be separated from the fourth portion. The fifth portion is collected in the line 51 at the base of the first cleaner and carder 47.

The sixth portion of the input is then conveyed through the condenser 53 and baled in the first bale press 57.

The first, the third, and the fifth portions of the input are consolidated in a line 63 to form a seventh portion of the input. The seventh portion of the input is then conveyed into the cyclone 65 to remove air and to form the material of the seventh portion into clusters of material.

The seventh portion of the input is fed by gravity into the drum screen cleaner 69. In the drum screen cleaner 69, the seventh portion is cleaned by lifting and tumbling the clusters of material of the seventh portion over the plurality of finger-shaped baffles 404, 408 to break up the clusters of material and to separate the heavy trash. The heavy trash separated drops through the screens 403, 409 and is collected by the conveyer 71 to form a ninth portion of the input. The motes and lighter trash retained by the drum screen cleaner 69 form an eighth portion of the input.

The eighth portion is conveyed through the condenser 82 to be carded and opened in the carder and opener 83. By subjecting the eighth portion to a plurality of abrupt deflections and accelerations in a circular direction of travel, a tenth portion of the input is formed by opening the fibers motes comprising primarily a short fiber fraction and lighter trash. The lighter trash contained in the eighth portion is also broken up into fine particles and loosened in the carder and opener 83 and a portion of the trash in the form of dust and lint fly is removed by air suction via lines 85, 87.

The tenth portion is then cleaned and carded in the second cleaner and carder 97 by subjecting the fibers of the tenth portion to a plurality of abrupt deflections and accelerations in a circular travel direction to assist in cleaning and orienting the fibers to form a twelfth portion of the input comprising a short fiber fraction. An eleventh portion of the input comprising lighter trash is also separated from the tenth portion.

The twelfth portion is conveyed through the condenser 101 and baled in the second bale press 105. The bales formed in the bale press 105 comprise a short fiber fraction. The ninth and the eleventh portions are combined into a thirteenth portion and delivered to the solid waste disposal system 77.

By operating the fiber recovery system as described above, the long fiber fraction collected in the first bale press 57 is maintained separate from the short fiber fraction collected at the second bale press 105. This method has several advantages since the long fiber fraction is more desirous for certain further processes. Therefore, by maintaining the separation between the long fiber fraction and the short fiber fraction, marketability of the product is enhanced.

With an input feed from a cotton gin, the system of the present invention is capable of obtaining at the first bale press 57 a 20 to 50 percent yield of long fibers from the input feed. The main length of these fibers is generally 0.7–0.9 inch with the longest fiber being generally between about 1.00–1.15 inches. The output at the second bale press 105 represents approximately 15–30 percent of the input material and generally has a mean length averaging 0.4–0.55 inch with the longest fiber generally being between approximately 0.95–1.10 inches. The exact length and percent yield of fibers are dependent upon the length and quality of the input feed to the system. The quality of the input feed varies from one cotton growing region to another.

An alternate embodiment of the present invention (shown in dashed lines in FIGS. 2 and 7) includes a line 113 which receives the output of the carder and opener 83 and returns the output to the line 39 which feeds the first reserve hopper-feeder 41. The short fiber fraction from the carder and opener 83 is mixed with the long fiber fraction retained by the lint cleaner 33 in the line 39 and conveyed to the reserve hopper-feeder 41. In this embodiment, the separation of the long and short fiber fractions is not accomplished. However, the cost of the system is reduced by the elimination of the second cleaner and carder 97 and the second bale press 105. For many uses, mixing of the long and short fiber fractions would not be detrimental. This arrangement, however, does provide for complete recovery of all the fibers formerly discarded by cotton ginning processes or early textile processes.

A further embodiment of the present invention (also shown in dashed lines in FIG. 2) includes a line 109 which receives the output of the drum screen cleaner and conveys it to a holding bin 111. In this arrangement the long fiber fraction is processed separately through the first cleaner and carder 47. After processing the long fiber fraction, the material in the holding bin is returned to the system and fed through the carder and opener 83 and then returned by the line 113 to the line 39 and the first reserve hopper-feeder 41 to be further cleaned and oriented by the first cleaner and carder 47. The holding bin could alternately hold the material obtained from the carder and opener 83. These arrangements also require only one cleaner and carder and one bale press, but still retain the advantage of maintaining the long fiber fraction and the short fiber fraction separate.

In a further arrangement of the present invention (also shown in dashed lines in FIG. 2), a line 115 takes the output of the lint cleaner 33 and adds the output to the material retained by the drum screen cleaner 69. This combined material is then conveyed through the carder and opener 83 and the cleaner and carder 97. This combined material is then pressed in the bale press 105. Alternatively, the line 115 could mix the material retained by the first cleaning and opening station 27 and mix this material with the output of the drum screen cleaner. By placing the line 115 at the output of the first cleaning and opening station, the fibers therein are fully opened by the carder and opener 83. By subjecting the long fiber fraction retained by the first cleaning and opening station 27 to the action of the carder and opener 83, some of the longer fibers are likely to be broken up resulting in an output consisting of a smaller percentage of longer fibers.

By using the various embodiments of the present invention, a method of controlling the quality and length of the output is provided. By mixing the material retained by either the first cleaning and opening stage 27 or the lint cleaner 33, the material at the bale press 105 is not as clean as the output which can be obtained at bale press 57. Also, the length of some of the fibers retained in these early stages is likely to be shortened when it is passed through the carder and opener 82. The highest quality output, i.e. the lowest non-lint content, is obtained by maintaining separate the different fiber fractions. However, by combining the outputs, considerable machinery expense is eliminated.

As shown in FIG. 2, the system of the present invention is a completely closed system to keep dust in the work area to a minimum. At the dust house 61 all solid waste particles such as dust and lint fly are combined with the other waste in the solid waste bin 77. This solid waste can be used as potting soil after composting. This combined trash material will be composed of approximately 30 percent plant trash parts, 30 percent lint fly, and 40 percent dust.

Figure 3:
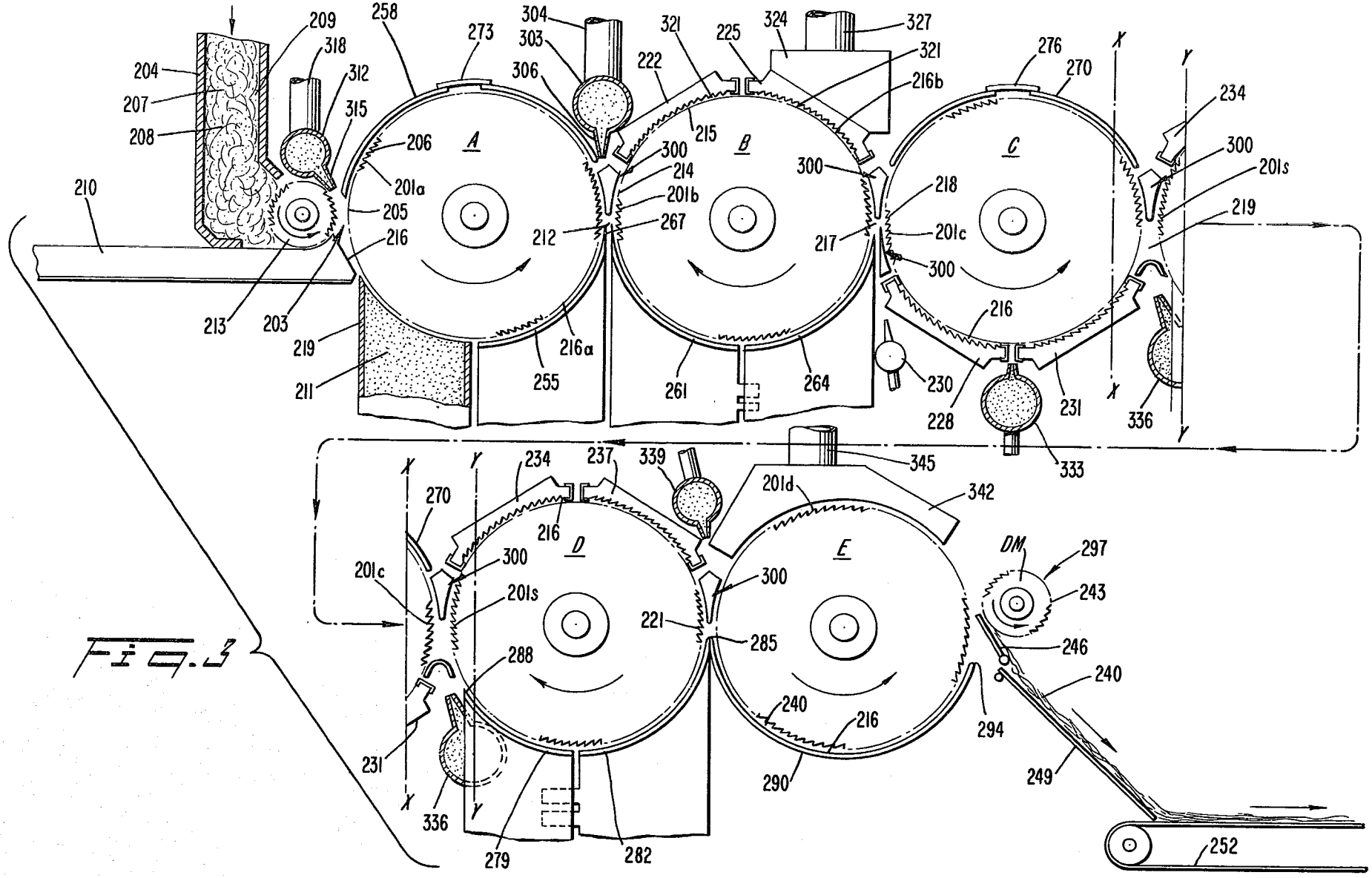
FIG. 3 is a simplified cross-sectional side elevational view of a cleaner and carder as employed in the present invention.

Referring to FIG. 3, it will be seen that a cleaner and carder 47, 97 as employed in the present invention comprises a train of rolls, designated A, B, C, D, and E, adjacently mounted for rotation about parallel axes. Roll A functions as a lickerin, rolls B, C and D are main treatment cylinders; and roll E is a consolidating cylinder. An important feature of the invention is that adjacent rolls rotate in opposite directions; or stated differently, alternate rolls rotate in the same direction. Thus, as indicated by the arrows on the respective rolls in FIG. 3 rolls A, C and E rotate counterclockwise, while rolls B and D rotate clockwise.

In a preferred embodiment of the present invention, the cleaner and carder does not employ the consolidating roll E. In such a case, the fiber is simply doffed directly off of the cylinder D by a plate or knife (not shown) arranged along the periphery of the roll D. The plate directs the fiber into an air chute where the fiber is transported by air suction within the chute to the condenser.

Each of the rolls A, B, C, D, and E in the train is provided with a plurality of fiber-grabbing, card clothing teeth 201*a*, 201*b*, 201*c*, 201*s*, and 201*d*, respectively, secured to the peripheries of the rolls. Another important feature of this invention is the angle at which these teeth are inclined. Thus, as shown in FIG. 3 the teeth on rolls A, B, C, and D have a substantial forward rake angle. That is, the forward faces of the teeth on the cylinders A, B, C, and D are all inclined at a substantial angle, e.g., from about 3° to about 50° and more typically from about 5° to about 40°, with respect to a radius, in the direction of rotation of the particular roll on which they are mounted.

However, on the optional consolidating roll E, the teeth are inclined at similar angles but opposite to the direction of rotation, that is rearwardly. It should also be noted here that in addition to or in lieu of teeth, roll E may be perforated to allow for air suction to assist or by itself hold the mass or web of fibers onto the cylinder. If roll E is perforated but without teeth, some fiber disparallelization may occur during condensing of the web. Similarly, the rolls A, B, C or D may be perforated to allow for such an air suction or vacuum holding technique. Such an air suction or vacuum holding technique may also allow for additional dust or other fine trash removal.

Preceding the train of rolls is a device such as a chute 204, to continuously supply a mass of fibers 207, from the lint cleaner 33 or the carder and opener 83, to be treated.

Referring once more to FIG. 3, the trash-containing fibers are seen to pass from the chute 204 to a feed plate 210, from which they are transferred by a feed roll 213 to teeth 201*a* of cylinder A. As the fibers are plucked from the nip between the feed roll and the feed plate and travel in a counterclockwise direction around the lower portion of the periphery of cyinder A, they are subjected to an initial orientation, combing, and cleaning action and form a layer 216. In the nip of rolls A and B, the layer 216 is transferred to the teeth 201*b* of the second treatment cylinder B and assume a clockwise path, as shown in FIG. 3 around the upper portion of the periphery of that roll. As the layer of fibers 216 next enters the nip of rolls B and C they are picked up by teeth 201*c* of the third cylinder C and continue in a counterclockwise direction along the lower portion of the periphery of roll C. In a similar manner, the layer 216 is then successively transferred to teeth 201*s* on clockwise rotating roll D. Because, as already described, adjacent rolls rotate in opposite angular directions, the layer of fibers assumes the sinuous path shown as it progresses from roll A to roll E.

Because the peripheral speed of cylinder A is greater than that of the feed roll 213, the layer of fibers 216 is of a lower area density than that of the mass supplied to the feed roll 213. In addition, the rotational speed of layer 216, as it is carried around the lower portion of cylinder A is sufficient to cause a substantial amount of the heavy trash, loosened or freed by the teeth 201*a*, together with a certain percentage of fiber, to be thrown off by centrifugal force and by the transversely striking forces applied by the teeth 201*a* as they come into contact with the heavy trash. These are drawn into a conventional fiber retriever 219, a portion of which is shown in FIG. 3, adjacent a sector of the periphery of roll A. As layer 216 enters the nip of rolls A and B, it is picked off from teeth 201*a* by teeth 201*b* of the second cylinder B. The latter, because it rotates at a greater peripheral speed than cylinder A, has a drafting and carding effect at the point of transfer in the nip of the two rolls.

Additional carding points along cylinder B are provided by a pair of adjacent stationary carding plates 222 and 225 mounted in juxtaposed relationship to sectors of the periphery of roll B. These stationary plates, coextensive with the length of the roll, have their inner, concave surfaces furnished with card clothing teeth which may also be inclined, at varying angles to a radius; in the same direction or opposite to the direction of rotation of roll B. Stationary carding plates, such as plates 222 and 225, are described in detail in U.S. Pat. No. 3,604,062, which is incorporated herein by reference. These plates are adjustably mounted on the supporting framework (not shown) in a manner familiar to skilled mechanics, and are set at the proper distance from the roll for optimum carding effect. Optionally, plates 222 and 225 may be spring-loaded or in a fixed position after adjustment.

The now partially carded fibers 216, traveling in a clockwise direction with roll B, are transferred to roll C in the nip between the two rolls. Roll C rotates at a peripheral speed greater than that of roll B. Hence, fibers 216 are subjected to further carding and drafting during the transfer. An important further novel feature relates to the two additional carding points provided on the periphery of roll C. These additional carding points comprise stationary carding plates 228 and 231, similar to plates 222 and 225. Carding plates 228 and 231, are adjustably mounted, either rigidly or spring-loaded, in a juxtaposed position to the periphery of roll C, but adjacent a sector substantially diametrically opposite the sector on roll B where plates 222 and 225 are mounted. The effect of so locating plates 228 and 231 is to subject opposite surfaces of the layer of fibers 216 to carding action. After passing stationary carding plates 228 and 231, in a counterclockwise direction, fibers 216 are transferred from third cylinder C, to fourth cylinder D, which rotates clockwise. Because cylinder D rotates at a peripheral speed greater than that of roll C, carding action and drafting also take place in this transfer. This carding action is augmented by the juxtaposition of stationary carding plates 234 and 237 adjacent the sector of roll D corresponding to that of roll B, to provide still two more carding points. As in the instances of plates 222, 225, 228 and 231, carding plates 234 and 237 are mounted to be adjustable in a known manner; and they may either be rigid or spring-loaded after adjustment.

At this point, the fibers are preferably doffed off the cylinder D and conducted to the condenser 53 or 101 and the bale press 57 or 105. If desired, however, consolidation of the fibers may be effectuated by providing the roll E which is rotated in an opposite direction to (e.g., counterclockwise) and at a peripheral speed substantially lower than that of roll D. Furthermore, by inclining the teeth 201*d* at an angle opposite to the direction of rotation, the fibers, as they transfer from roll D to roll E, are subjected to a condensing action. The fibers 216, now in the form of a denser, self-sustaining web 240, are presented to fluted roll 243 (DM) which also rotates in a counterclockwise direction, thereby removing or doffing web 240 from roll E. The web 240 then passes between the fluted roll 243 and a knife edge 246 causing the web to slide down the stationary inclined surface 249 to an endless belt 252 for recovery or removal to a location for further processing. An assembly for removing the condensed web 240 from roll E, as just described, is further described in detail in U.S. Pat. No. 3,283,366, which is incorporated herein by reference.

Figure 4:
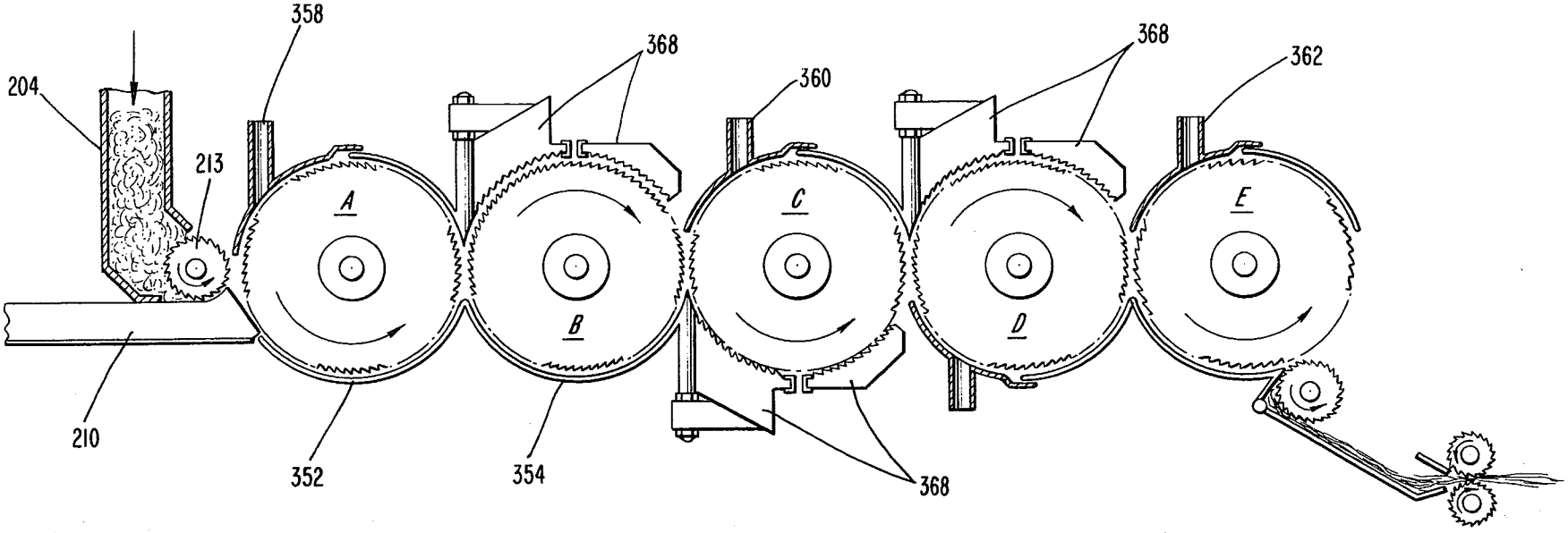
FIG. 4 is a simplified cross-sectional side elevational view of a carder and opener as employed in the present invention.

In a preferred embodiment, as shown in both FIG. 3 and FIG. 4, rolls A, B, C, D, and E are the same diameter, although this is not a requirement. The present invention affords the additional advantage of increased economy of manufacture since it is not necessary to obtain rolls of varying sizes to construct the several components.

Because a great deal of the trash removal normally occurs at the junction or zone between the feed roll and cylinder A, it is typically advisable to provide a high capacity fiber and trash receiving component adjacent that portion of the periphery just beyond feed roll 213 and feed plate 210. Already mentioned as being suitable for this purpose is a conventional fiber retriever, various designs of which are well known to those skilled in the art. A portion of the receiving duct 219 for such a fiber retriever is shown in FIG. 3. Screen 255 (preferably a solid screen) is contoured to be concentric with cylinder A and is adjustable with respect to its distance from the periphery of the latter by conventional means (not shown). A conventional bonnet 253 is also shown to cover a sector opposite the solid screen 255. This plate is also adjustable by an apparatus (not shown) similar, if desired, to those used for adjustably mounting stationary carding plates 222 and 225, for example. Means for adjustably mounting the cover plates are known and do not constitute a part of the present invention.

Referring once more to FIG. 3, toothed cylinder B is seen to be provided with screens 261 and 264 substantially diametrically opposite stationary carding plates 222 and 225. Screens 261 and 264 are concentrically concave with the periphery of toothed cylinder B and are adjustable with respect to their distance from that periphery by a conventional apparatus (not shown) which also do not constitute part of the present invention. These screens are, preferably, solid, as shown, but can also be perforated or ribbed. Screens 261 and 264, respectively extend from a point adjacent the forward edge 267 of screen 255 to a point almost in the nip of rolls B and C, a sector normally corresponding to about one-third of the circumference of roll B.

Turning attention now to roll C, it will be seen from FIG. 3 that this roll is provided with a concentrically concave cover plate 270 substantially diametrically opposite stationary carding plates 228 and 231. Plate 270 is also adjustably mounted (not shown) in a manner similar to that of cover 258. Optional, but not necessary, are windows 273 and 276 in covers 258 and 270, respectively, which can be provided for the purpose of inspecting the condition of the card clothing and for detecting any occurrence of "blowback", which are fibers torn loose from one area of the web and eventually repositioned in another area of the web, thus leading to non-uniformity in the web.

Again referring to FIG. 3, cylinder D is seen to be provided with adjustable (by means not shown) solid screens 279 and 282, similar to screens 261 and 264, adjacent a sector of the periphery of cylinder D substantially diametrically opposite stationary carding plates 234 and 237. Screens 279 and 282 together cover about one-third of the circumference of cylinder D, extending, in the direction of rotation from a point 285, near the nip of rolls D and E to a point 288, substantially distant from the nip of rolls C and D. A curved plate 290 extends from point 285 around a sector of roll E, corresponding substantially to the sector of roll D encompassed by screens 279 and 282, to a point 294 adjacent the web-doffing assembly designated generally as 297.

Although, as previously noted, a great deal of the cleaning (i.e., removal of heavy trash and motes carried by the cotton) takes place at cylinder A where the heavy trash, and motes together with some fiber, are thrown off by centrifugal and tangential forces and caught in fiber retriever 219, some smaller trash particles typically remain in the fibers and continue around the periphery of cylinder A past the entrance duct of fiber retriever 219. This remaining trash, together with the fiber is picked up by the next cylinder B. Some of this trash, particularly the loosely-held surface trash, together with lint fly is removed from the body of fibers through a cleaning device, designated generally by the reference character 300, and shown schematically near the nip of rolls A and B. This trash removing device is the subject of U.S. Pat. No. 3,858,276 which is incorporated herein by reference. The loose material removed by the trash cleaner 300 is sucked into vacuum pipe 303 through nozzle 306, substantially coextensive with the length of roll A, pointed into the nip of rolls A and B. Pipe 303 is connected to any suitable suction device (not shown) by a duct 309.

Loose trash not removed by vacuum pipe 303, together with trash and lint fly adhering to feed roll 213 are removed by vacuum pipe 312 through nozzle 315, also substantially coextensive with the length of roll A, pointed into the nip of feed roll 213 and cylinder A. Vacuum pipe 312 can be connected by a duct 318 to the same suction device as duct 309.

As the body of fibers is transferred from cylinder A to faster-moving roll B the fibers undergo drafting and carding, processes which, as previously described, are augmented by stationary carding plates 222 and 225. This carding and drafting action results in an attenuation of the body of fibers and a loosening of a quantity of trash and pills exposed by the further opening of the fibers, especially those on the surface in contact with teeth 321 on carding plates 222 and 225. This trash, dust, and lint fly are drawn off through plenum 324 which covers carding plate 225 and extends over the nip of rolls B and C. Plenum 324 can also be connected, by means of duct 327 to the same suction device as ducts 309 and 319.

The mass of fibers 216, as they transfer from roll B to faster-rotating roll C, are again subjected to drafting and carding actions, thus further reducing the area density of the fiber web 216 and loosening or exposing a further amount of remaining fine trash. The surface trash, loosened by the carding action of plates 228 and 231 can be removed by the installation of an additional unit 300; similar to the previously mentioned trash-removing devices 300, in the nip of rolls B and C (as shown in FIG. 3). Loosened trash, dust, and lint fly can then be removed from roll C by vacuum pipes 330, 333 and 336 similar to those previously described.

The already attenuated web 216 is then further drafted and carded in the nip between rolls C and D as it is transferred to the latter. Also, as already described, web 216 is subjected to further carding action by stationary carding plates 234 and 237. Further residual trash is loosened by the carding and drafting action in the nip of rolls C and D and under stationary carding plates 234 and 237, and separated from the surface of the web by the knife blades of a further pair of trash-removing units 300, one of which can be installed near the nip between rolls C and D before carding plate 234 and the other after carding plate 237. The so separated trash, dust, and lint fly can then be drawn off through vacuum pipe 339 and through plenum 342 which is connected to a source of vacuum (not shown) by duct 345, in the manner already described.

If roll E is employed, web 216, as it enters the nip between rolls D and E, is deposited on the rearwardly inclined teeth 201*d* of the slower-rotating roll E. The increase in density or weight per unit length of the more dense web 240 depends on the relative speeds of rolls D and E. The web 240, free of trash, self-sustaining, and completely opened is removed from roll E by means of the previously mentioned doffing assembly 297 and deposited on conveyor 252 for transportation to the next intended operation.

In operation, and referring to FIG. 3, a gross or thick mass 207 of tangled randomly oriented fibers containing trash and fiber motes may be treated by the cleaner and carder. This is accomplished by providing a mass 207 of fibers in a batt form having longitudinal and lateral dimensions substantially greater than its dimensional thickness, with opposite face portions 208 and 209 of the batt. The mass 207 of fibers is then relatively slowly conveyed in the batt form from a feed roll 213 to a first junction 203 at a suitable rate of above about 400 pounds per hour while tightly gripping or holding the mass to maintain the gross mass of fibers substantially stationary in a direction generally transverse or perpendicular to the longitudinal or initial feed direction. It should be noted here that usage of the term "longitudinal" does not necessarily imply a horizontal direction or a vertical direction, as the fiber treatment process and unit may be operated in a variety of configurations and spatial relationships as otherwise discussed herein. The peripheral speed of the feed roll may vary, and typically is between about 10 and about 100 feet per minute.

The mass 207 of fibers is then tangentially directed against teeth 201*a* on a cylindrical surface 205 of a first rotating cylinder A, the teeth 201*a* having forward faces 206 inclined at substantial angles in the direction of rotation of the cylinder as shown by the arrows in FIG. 3. This causes a sudden deflection at the first junction 203 to cause the leading portions of mass fractions of fibers to experience an abrupt deflecting motion generally transverse to the longitudinal travel direction and simultaneously subjects the leading fiber portions of the mass fractions to an abrupt accelerating force in a first circular direction of travel for the fibers, as shown by the arrows in FIG. 3. This force tends to accelerate the mass fractions in the travel direction to a relatively high speed, e.g., above about 2,000 feet per minute, and preferably between about 2,000 and about 6,000 feet per minute. The deflecting in the transverse direction and accelerating in the circular travel direction while gripping the gross mass of fibers effects plucking or pulling of mass fractions or portions from the gross mass of tangled, randomly oriented fibers, and assists in thinning and orienting (parallelizing fibers in the feed direction) the mass 207 in the travel direction and assists in disentangling the mass of fibers. The combined effects of the sudden transverse deflection, circular accelerating force and some combing by the teeth 201*a* also cause trash and motes 211 to be thrown downwardly and outwardly and be freed and separated from the mass 207 of fibers. The trash is transported away from the area of the mass of fibers through line 51 (FIG. 2).

The mass of fibers at a second junction 212 downstream of the first junction 203 are then directed tangentially against teeth 201*b* on the cylindrical surface 214 of a second rotating cylinder B, the second cylinder rotating in a direction opposite the first cylinder A and having teeth 201*b* with forward faces 215 inclined at a substantial angle in the direction of rotation of the second cylinder B, so as to cause a generally tangential accelerating force applied by the teeth 201*b* of the second cylinder B to the fibers in a second circular travel direction sinuous to the first or upstream circular travel direction and to cause mass fractions of the fibers to accelerate freely or virtually unhindered or unretarded in the second circular travel direction as shown by the arrows in FIG. 3 from the teeth 201*a* of the first cylinder A. This tangential or sinuous transfer from cylinder A to cylinder B also effects a carding of a first face portion or surface 216*a* of the layer 216 or mass fractions of fibers at the second junction 212. The combined effects of accelerating tangentially or sinuously and carding on a first face portion 216*a* tend to thin or draft apart the individual fibers in the travel direction and aid in loosening trash and disentangling of individual fibers in the mass of fibers.

At a third junction 217 downstream of the second junction 212 the mass or layer 216 of the fibers is directed tangentially against teeth 201*c* on cylindrical surface 218 of a third rotating cylinder C. The third rotating cylinder C rotates in a direction opposite the rotation of the second cylinder B and has teeth 201*c* with forward faces inclined at a substantial angle in the direction of rotation of the third cylinder C. A generally tangential acceleration is applied by the teeth 201*c* of the third cylinder C to the fibers in the third circular travel direction sinuous to the second or upstream travel direction to cause the fibers to accelerate freely in the third circular travel direction from the teeth 201*b* of the second cylinder B. Speeds at cylinder C may vary, but are generally between about 5,000 feet per minute to above about 10,000 feet per minute, typically between 5,000 and 9,500 feet per minute and preferably are between about 7,000 and about 8,000 feet per minute at the third junction 217. Carding of a second opposite face portion of the mass or layer 216 of the fibers is also effected. The combined effects of accelerating sinuously and carding on the second or opposite face portion tends to thin and draft apart individual fibers and aids in loosening of trash from the fibers.

The mass 207 of fibers is subjected at the junction 219 between cylinder C and cylinder D to the same operation and effects as at junction 212 between cylinder A and cylinder B. If desired, cylinder D may be omitted in certain instances such as when dealing with a fiber feed of lower trash content and/or higher initial orientation, higher initial uniformity, or more complete initial finer opening. Also, if desired, additional toothed carding or non-toothed transfer cylinders beyond the three carding cylinders B, C and D as shown in FIG. 3, may also be used at various peripheral speeds.

At various locations (222,225), (228,231) and (234,237) the mass of fibers may be additionally carded on the exposed face portions of the batt while the mass of fibers are in a circular travel direction of travel at a constant velocity so as to cause a retarding effect on fiber portions in the carded face portions while the velocity of remaining fiber portions in the batt is being maintained, thereby aiding in orienting and separating individual fibers in the travel direction and laterally thereof and aiding in further fiber disentanglement and loosening of trash in the mass of fibers. Also, a number of devices 219, 306, 315, 330, 333, 336, and 339 are provided for conveying loosened and freed trash away from the mass 207 of fibers.

After effecting treatment as described above in conjunction with cylinders A to D the mass 207 of fibers is preferably doffed from the cylinder D and transported by air to the condenser. However, the mass of fibers may, if desired, be condensed by subjecting the mass 207 at a junction 221 downstream of the fourth junction 219 by directing the mass of fibers against the slower moving cylinder E so as to condense the fibers by subjecting them to a tangential decelerating force in a circular travel direction sinuous to the circular travel direction of the preceding fiber treatment cylinder. The decelerating force causes consolidation of the individual fibers and condensing of the web while maintaining disentanglement of the individual fibers.

The consolidated fiber batt may then be removed or doffed from the consolidating cylinder E by a conventional fluted doffing roll 243 (DM) so as to recover a consolidated, substantially trash-free and substantially nep-free mass of fibers having a substantial portion of individual fibers therein oriented in the longitudinal direction.

In the foregoing description of the cleaner and carder referring to FIG. 3, reference was made to the several trash removing assemblies and to the suction devices used to collect loose trash, lint fly, dust, and the like. The carder and opener 83 as illustrated in FIG. 4 is provided with a substantially solid shroud member 352 arranged along the lower portion of roll A in place of the fiber retriever 219 (FIG. 3). The remainder of the carder and opener (only partially shown in FIG. 4) is substantially the same as the cleaner and carder of FIG. 3. Air suction devices 358, 360, and 362 (see FIG. 4) remove dust or lint fly generated by the action of the rolls A, B, C, D, and E. Carding plates 368 are also arranged about the periphery of the rolls. The operation of the carder and opener 83 is substantially the same as in FIG. 3 but the embodiment of FIG. 4 is used primarily as a fiber opener, which will be explained in more detail below, rather than a fiber cleaner as in FIG. 3.

The solid shroud member 352 prevents any trash or pills from being discharged as the fiber is picked up by roll A. The shroud 354 prevents any fiber carried on roll B past the transfer point between rolls B and C from being discharged. As used in the present invention, the carder and opener 83 receives a product which is substantially free of large trash. By closing off the opening under the first cylinder A any fiber motes and lighter trash are prevented from dropping out. By shrouding the waste discharge at the first cylinder, all the fibrous material including the small tufts of fibrous material, pills or motes, is retained on roll A for subsequent transfer to roll B to be further carded and opened.

As described in connection with FIG. 3, the transfer of the layer of fiber from each successive roll (A to B to C to D) has a drafting and carding effect on the fiber. In the embodiment of FIG. 4, the motes which were prevented from dropping out by the shroud 352 are also subjected to the drafting and carding action first at the transfer between roll A and roll B. The partially opened motes are also subjecting to carding at the stationary carding plates 368 arranged on the periphery of roll B. This combined action is sufficient to open up the motes and to recover the short cotton fiber fraction contained therein. Any motes not opened by the action of the first transfer from roll A to roll B are repeatedly subjected to a similar action at the transfer to subsequent rolls C and D and also at the carding plates on the periphery of rolls C and D. In this manner, substantially all of the motes are opened to provide a usable short fiber fraction.

The standard ventillation system described in connection with the cleaner and carder illustrated in FIG. 3 is retained in the carder and opener illustrated in FIG. 4 to remove dust and lint fly. A large quantity of dust is produced in the carder and opener 83. Any particles of trash which are in the material fed to the carder and opener are prevented from falling downwardly by gravity because of the protective shroud. Therefore, these particles are carried through the cylinders of the carder and opener and a portion of the trash particles is broken up into fine dust by the action upon the material as it is transferred from one roll to the next and by the carding plates arranged on the periphery of each of the rotating cylinders. Since a portion of this trash is finely pulverized into dust and the fibers are thoroughly opened, a portion of the dust can be removed by the standard ventillation system (as more clearly illustrated in the cleaner and carder of FIG. 3).

The product which is conducted into the carder and opener 83 should preferably be subjected to a precleaning step prior to processing in the carder and opener. If the input to the carder and opener is not free of large particles of trash, the trash would prove detrimental to both the carder and opener and the output therefrom. The action of the carder and opener could not be expected to remove a large quantity of trash. If too much trash is contained in the cotton fed into the carder and opener, the quantity of dust generated would be too great to be effectively separated from the fiber and carried away by the ventilation system. Consequently, the end product would contain too much trash to be readily marketable. Also, if a large quantity of trash particles are contained in the incoming cotton, the trash wears down the teeth both on the rolls and on the carding plates arranged on the periphery of the rolls.

Therefore, it is preferable that the trash collected from the initial opening and cleaning station 27, the lint cleaner 33, as well as the first cleaner and carder 47 be subjected to a cleaning stage in the drum screen cleaner 69 which effectively removes a substantial quantity of heavy trash. By this arrangement the carder and opener 83 receives a product which contains substantially only lighter trash and the carder and opener can be used primarily as a fiber opening device and not primarily as a cleaner.

SUMMARY OF THE ADVANTAGES OF THE PRESENT INVENTION

The fiber recovery system of the present invention provides a method for obtaining the substantially complete recovery of all of the usable cotton fiber from waste material received from a ginning process or early textile process. Depending upon the quality of the incoming feed to the system, the total fiber recovery system of the present invention will yield a substantially higher quantity of usable fiber from this waste material than conventional fiber recovery systems.

The present invention also provides a method which separates the recovered fibers according to their length. The yield at the first bale press 57 consists of a long fiber fraction whereas the output which is baled in the second bale press 105 consists of a short fiber fraction. With this separation of fibers by length the sale of the fibers for varying purposes is enhanced.

The novel arrangement of the steps of the present invention not only permits the motes or tightly packed fibers to be opened in the carder and opener, but also produces a clean product. The longer fiber fraction is first separated from the input feed in the first opening and cleaning step and in the lint cleaner. The drum screen cleaner removes a large quantity of the trash particles from the waste material recovered in the prior processing steps, thereby increasing the efficiency and wear life of the carder and opener. By removing the trash in the drum screen cleaner, the carder and opener produces an output which contains a lesser quantity of trash.

The method and apparatus of the present invention produces a very low nonlint content in the two fiber length distributions which the system generates. By decreasing the non lint content of the output, the fiber becomes more valuable and produces a larger clean fiber yield when passed through a finishing card.

The method of the present invention can also be used to obtain an output containing mixed fiber lengths.

The principles and preferred embodiments of the present invention have been described in the foregoing specification. However, the invention which is intended to be protected is not to be construed as limited to the particular embodiments disclosed. It will be apparent to those skilled in the art that numerous modifications, variations, substitutions, and equivalents exist for features of the invention described herein, which do not materially depart from the scope of this invention. The embodiments disclosed are to be regarded as illustrative rather than restrictive. Accordingly, it is expressly intended that all such modifications, variations, substitutions, and equivalents which fall within the spirit and the scope of the invention as defined in the appended claims be embraced thereby.

What is claimed is:

1. A method of recovering fiber from a fiber containing material comprising the steps of:

(I) opening an input feed of material in at least a first opening and cleaning station, said station separating the input feed into a first portion of the input feed primarily comprising trash and motes and a fourth portion of the input feed primarily comprising fibers and relatively smaller trash;

(II) cleaning and carding the fourth portion of the input to obtain a sixth portion of the input comprising a long fiber fraction by subjecting the fibers of the fourth portion to a plurality of abrupt deflections and accelerations in a circular travel direction to assist in cleaning and orienting the fibers of the fourth portion and to assist in disentangling the fibers of the fourth portion and also to cause a fifth portion of the input comprising smaller trash and motes to be freed and separated from the fibers of the fourth portion;

(III) consolidating the first and the fifth portions of the input into a seventh portion of the input;

(IV) cleaning the seventh portion of the input in a drum screen cleaner comprising the steps of:

(A) lifting and tumbling the seventh portion over a plurality of finger-shaped baffles to break up clusters of material and separate the trash; and (B) allowing the relatively heavy trash to drop through a screen to form a ninth portion of the input feed while retaining the motes and lighter trash to form an eighth portion;

(V) carding and opening the eighth portion, particularly the motes, to obtain a tenth portion of the input primarily comprising a short fiber fraction and fine trash by subjecting the eighth portion to a plurality of abrupt deflections and accelerations in a circular direction of travel to assist in thinning and opening the motes of the eighth portion and to assist in disentangling the fibers, and also to cause the lighter trash to be broken up into fine particles and loosened;

(VI) cleaning and carding the tenth portion to obtain a twelth portion of the input comprising a short fiber fraction by subjecting the fibers of the tenth portion to a plurality of abrupt deflections and accelerations in a circular travel direction to assist in cleaning and orienting the fibers of the tenth portion and to tend to separate and to assist in disentangling the fibers of the tenth portion and also to cause an eleventh portion of the input comprising fine trash to be freed and separated from the fibers of the tenth portion.

2. The method of claim 1 further comprising the steps of:

cleaning and opening the fourth portion of the input feed to remove a third portion of the input feed comprising motes and relatively smaller trash and to retain a new fourth portion of the input primarily comprising a long fiber fraction with lesser quantities of motes and trash;

conveying the new fourth portion to be cleaned and carded as in step (II); and consolidating the first, the third, and the fifth portions of the input to form the seventh portion of the input.

3. The method of claim 2 further comprising the step of consolidating the ninth portion and the eleventh portion to form a thirteenth portion of the input comprising trash.

4. The method of claim 1 further comprising the step of withdrawing a portion of the trash broken up and loosened in step (V) by air suction.

5. The method of claim 1, further comprising the steps of:

separately baling the sixth portion into bales comprising the long fiber fraction; and separately baling the twelth portion to obtain bales comprising the short fiber fraction.

6. The method of calim 1, wherein the tenth portion is combined with the fourth portion whereby the tenth and the fourth portions are cleaned and carded together to produce a single output comprising mixed long and short fiber fractions.

7. The method of claim 1, further comprising the steps of:

conveying the eighth portion prior to step (V) to a holding bin;

returning the eighth portion to be carded and opened as in step (V) to produce the tenth portion; and cleaning and carding the tenth portion as in step (VI) to obtain the twelfth portion after the fourth portion has been cleaned and carded into the sixth portion to maintain the sixth and the twelfth portions separate.

8. The method of claim 1, further comprising the step of subjecting the seventh portion to a cyclone to remove the air and form clusters of material prior to step (IV).

9. The method of claim 1, further comprising the step of subjecting the fourth portion to carding and opening as in step (V) prior to cleaning and carding the fourth portion in step (II).

10. The method of claim 1, further comprising the step of combining the fourth portion and the eighth portion to be subjected to both (1) carding and opening and (2) cleaning and carding together to form a single output comprising a short fiber fraction.

11. The method of claim 1 wherein the fourth, the eighth, and the tenth portions are further carded individually after each successive one of the plurality of abrupt deflections and accelerations in the circular travel direction.

12. The method of claim 1, further comprising the steps of:

collecting the dust and lint fly generated by steps (I), (II), (IV), (V), and (VI); and conveying the dust and lint fly to a dust house.

13. The method of claim 1, further comprising the steps of:

opening bales to produce the fiber containing material; and drying the material to remove moisture prior to step (I).

14. The method of claim 1 or 13 wherein the input feed of material comprises waste discarded by a ginning process or early textile mill process.

15. A method of recovering fiber comprising the steps of:

opening and cleaning an input feed of material in at least one location to remove a first quantity of trash and motes from the input feed, and to retain the remaining input feed;

subjecting the remaining input feed to a plurality of abrupt deflections and accelerations to remove a second quantity of trash and motes;

collecting the first and the second quantities of trash and motes to form a third quantity of trash and motes;

cleaning the third quantity of trash and motes to remove a substantial quantity of the heavy trash and to retain the motes and lighter trash;

subjecting the motes and lighter trash to a plurality of abrupt deflections and accelerations to open the motes to obtain a short fiber fraction and break up the lighter trash.

16. The method of claim 15 further comprising the step of subjecting the opened motes and lighter trash to a plurality of abrupt deflections and accelerations to remove the lighter trash and disentangle the short fiber fraction obtained from the motes.

17. The method of claim 16 further comprising the steps of:

separately baling the fibers remaining after subjecting the remaining input feed to a plurality of abrupt deflections and accelerations; and separately baling the fibers remaining after subjecting the opened motes and lighter trash to a plurality of abrupt deflections and accelerations.

18. The method of claim 15 further comprising the step of withdrawing a quantity of the lighter trash broken up by the abrupt deflections and accelerations by air suction.

19. The method of claim 15 wherein cleaning the third quantity of trash and motes comprises the steps of:

lifting and tumbling the third quantity over a plurality of finger-shaped baffles to break up clusters of material and separate the trash; and allowing heavy trash to drop through a screen while retaining the motes and lighter trash.

20. The method of claim 15 further comprising the step of combining the opened motes with the remaining input feed whereby the opened motes and the remaining input feed are subjected to abrupt deflections and accelerations together.

21. The method of claim 15 further comprising the step of collecting dust and lint fly generated by the method of recovering fiber.

22. A continuous, interconnected system for recovering fiber comprising:

means for opening and cleaning an input feed of fiber containing material in at least one location to remove a first quantity of trash and motes from the input feed, and to retain the remaining input feed;

means for subjecting the remaining input feed at a second location to a plurality of abrupt deflections and accelerations in a circular travel direction to remove a second quantity of trash and motes, and to retain a long fiber fraction of the input feed;

means for collecting the first and second quantities of trash and motes to form a third quantity of trash and motes;

means for cleaning the third quantity of trash and motes at a third location to remove a substantial quantity of the heavy trash and to retain the motes and lighter trash; and means for subjecting the motes and the lighter trash at a fourth location to a plurality of abrupt deflections and accelerations in a circular travel direction to open the motes and break up the lighter trash and recover a short fiber fraction from the motes.

23. The apparatus of claim 22 further comprising means for subjecting the opened motes and lighter trash at a fifth location to a plurality of abrupt deflections and accelerations to clean and disentangle the short fiber fraction obtained from the notes.

24. The apparatus of claim 22 wherein the means for cleaning the third quantity of trash and motes comprises a rotating drum surrounded by a screen having a plurality of finger-shaped baffles arranged on an inside periphery of the drum, which baffles break up clusters of material and separate the trash whereby heavy trash drops through the screen while the motes and lighter trash are retained.

25. A method of recovering usable fiber from an input feed of waste discarded by a ginning process or early textile mill process comprising a mass of randomly oriented mixed fibers, motes and trash comprising the steps of:

(I) opening the input feed at a first opening and cleaning station, said station separating the input feed into a first portion of the input feed primarily comprising trash and motes and a second portion of the input feed primarily comprising fibers and relatively smaller trash;

(II) cleaning and opening the second portion of the input feed to remove a third portion of the input feed primarily comprising motes and relatively smaller trash and a fourth portion of the input primarily comprising a long fiber fraction;

(III) cleaning and carding the fourth portion of the input to obtain a sixth portion of the input comprising a long fiber fraction comprising the steps of:

(A) subjecting the fibers of the fourth portion to an abrupt deflection at a first location to cause leading fibers to experience a deflecting motion generally transverse to a longitudinal travel direction and simultaneously subjecting the leading fibers to the fourth portion to a sudden accelerating force in a first circular direction of travel of the fibers, the deflecting in the transverse direction and accelerating force in the circular travel direction assisting in thinning and orienting the fibers of the fourth portion in the first travel direction and assisting in disentangling the fibers of the fourth portion and the deflecting and accelerating also causing trash and motes to be freed and separated from the fibers of the fourth portion;

(B) at a second location downstream of the first location subjecting the fibers traveling in the first circular travel direction to a generally tangential accelerating force in a second circular travel direction while carding a first face portion of the fibers at the second junction, the combined effects of accelerating sinuously and carding on the first face portion tending to thin and draft apart individual fibers in the second travel direction and tending to separate and disentangle individual fibers laterally of the second travel direction and aiding in loosening of trash from the fibers;

(C) at a third location downstream of the second location subjecting the fibers traveling in the second circular travel direction to another generally tangential accelerating force in a third circular travel direction sinuous to the second circular travel direction to cause the fibers to accelerate freely in the third circular travel direction while at the third location carding a second face portion on a side opposite the first face portion of the fibers, the combined effects of accelerating sinuously and carding on the second opposite face portion tending to thin and draft apart individual fibers in the third travel direction and tending to separate and disentangle individual fibers laterally of the third travel direction and aiding in further loosening trash from the fibers; and (D) collecting the trash and motes rejected at the first location, the second location, and the third location to form a fifth portion of the input;

(IV) consolidating the first, the third, and the fifth portions of the input into a seventh portion of the input;

(V) cleaning the seventh portion of the input in a drum screen cleaner comprising the steps of:

(A) lifting and tumbling the seventh portion over a plurality of finger-shaped baffles to break up clusters of material and separate the trash; and (B) allowing the relatively heavy trash to drop through a screen to form an ninth portion of the input feed while retaining the motes and lighter trash to form an eighth portion of the input;

(VI) carding and opening the eighth portion, particularly the motes, to obtain a tenth portion of the input primarily comprising a short fiber fraction and fine trash comprising the steps of:

(A) subjecting the fibers of the eighth portion to an abrupt deflection at a first location to cause leading fibers to experience a deflecting motion generally transverse to a longitudinal travel direction and simultaneously subjecting the leading fibers of the eighth portion to a sudden accelerating force in a first circular direction of travel of the fibers, the deflecting in the transverse direction and accelerating force in the first circular travel direction assisting in thinning and opening the motes of the eighth portion and assisting in disentangling the fibers, and the deflecting and accelerating also causing the lighter trash to be broken up into fine particles and loosened;

(B) at a second location downstream of the first location subjecting the fibes traveling in the first circular travel direction to a generally tangential accelerating force in a second circular travel direction to cause the fibers to accelerate freely in the second circular travel direction while carding a first face portion of the fibers at the second junction, the combined effects of accelerating sinuously and cardingd on the first face portion further tending to thin and open individual fibers and motes in the second travel direction and tending to separate and disentangle individual fibers laterally of the second travel direction and aiding in loosening and breaking up trash;

(C) shrouding the fibers by at least the first and second locations in the first and the second circular travel directions to prevent the lighter trash broken up and loosened from the fibers from being thrown downwardly and outwardly from the circular travel directions; and (D) at a third location downstream of the second location subjecting the fibers traveling in the second circular travel direction to another generally tangential accelerating force in a third circular travel direction sinuous to the second circular travel direction to cause the fibers to accelerate freely in the third circular travel direction while at the third location carding a second face portion on a side opposite the first face portion of the fibers, the combined effects of accelerating sinuously and carding on the second opposite face portion tending to further thin and open individual fibers and motes in the third travel direction and tending to separate and disentangle individual fibers laterally of the third travel direction and aiding in further loosening and breaking up trash contained in the fibers;

(VII) cleaning and carding the tenth portion to separate the tenth portion into a twelth portion of the input comprising a short fiber fraction and an eleventh portion of the input comprising fine trash, comprising the steps utilized in step (III).

26. The method of claim 25 further comprising the step of withdrawing a portion of the trash freed and broken up in steps (VI) (A), (VI) (B), and (VI) (D) by air suction.

* * * * *